US007100280B2

(12) United States Patent
Moeller et al.

(10) Patent No.: US 7,100,280 B2
(45) Date of Patent: Sep. 5, 2006

(54) METHOD FOR PRODUCING A HEAT EXCHANGER

(75) Inventors: Stefan Moeller, Munich (DE); Alfred Wanner, Deisenhofen (DE); Gabriele Engl, Munich (DE); Thomas Hecht, Gauting (DE); Wolfgang Suessmann, Munich (DE); Herbert Aigner, Englesberg (DE)

(73) Assignee: Linde Aktiengesellschaft, Hollriegelskreuth (DE)

( * ) Notice: Subject to any disclaimer, the term of this patent is extended or adjusted under 35 U.S.C. 154(b) by 186 days.

(21) Appl. No.: 10/785,484

(22) Filed: Feb. 25, 2004

(65) Prior Publication Data

US 2005/0066524 A1 Mar. 31, 2005

(30) Foreign Application Priority Data

Feb. 25, 2003 (DE) ..... 103 08 015
Apr. 11, 2003 (DE) ..... 103 16 712
May 28, 2003 (EP) ..... 03012311

(51) Int. Cl.
*B21D 39/06* (2006.01)
*B21D 53/02* (2006.01)
*B21D 53/08* (2006.01)
*B23P 15/26* (2006.01)

(52) U.S. Cl. ..... 29/890.039; 29/890.03; 29/890.052; 29/726; 29/726.5; 165/153; 165/166

(58) Field of Classification Search ..... 29/890.3, 29/890.039, 890.052, 726, 726.5; 165/152–153, 165/164–166

See application file for complete search history.

(56) References Cited

U.S. PATENT DOCUMENTS

| | | | | |
|---|---|---|---|---|
| 3,792,842 | A * | 2/1974 | Nakako et al. | 261/148 |
| 5,144,809 | A * | 9/1992 | Chevalier et al. | 165/166 |
| 5,324,452 | A * | 6/1994 | Allam et al. | 252/373 |
| 5,333,683 | A * | 8/1994 | Arriulou et al. | 165/166 |
| 5,529,116 | A * | 6/1996 | Sasaki et al. | 165/144 |
| 6,089,313 | A * | 7/2000 | Levy et al. | 165/140 |
| 6,349,566 | B1 * | 2/2002 | Howard et al. | 62/627 |
| 6,437,662 | B1 | 8/2002 | Taniguchi | |
| 6,945,322 | B1 * | 9/2005 | Ikeda | 165/144 |
| 2002/0011331 | A1 * | 1/2002 | Lehman et al. | 165/166 |
| 2002/0131919 | A1 * | 9/2002 | DeBellis et al. | 422/188 |
| 2004/0108105 | A1 * | 6/2004 | Dwyer | 165/181 |

* cited by examiner

*Primary Examiner*—David P. Bryant
*Assistant Examiner*—Sarang Afzali
(74) *Attorney, Agent, or Firm*—Millen, White, Zelano & Branigan, P.C.

(57) ABSTRACT

The invention relates to a method for producing a plate heat exchanger from a plurality of heat exchanger blocks (1*a*, 1*b*). Each heat exchanger block (1*a*, 1*b*) has mounted on it a header (6*a*, 7*a*, 6*b*, 7*b*) which extends over at least part of one side of the heat exchanger block (1*a*, 1*b*). The heat exchanger blocks (1*a*, 1*b*) are arranged next to one another, and the headers (6*a*, 6*b*; 7*a*, 7*b*) of two adjacent heat exchanger blocks (1*a*, 1*b*) are provided on their mutually confronting sides with orifices and are connected to one another in such a way that a flow connection occurs between the two headers (6*a*, 6*b*; 7*a*, 7*b*).

22 Claims, 2 Drawing Sheets

METHOD FOR PRODUCING A HEAT EXCHANGER

Figure 1:
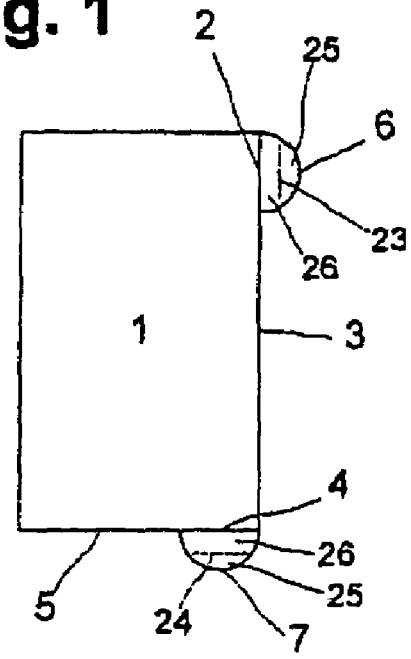

The invention relates to a method for producing a plate heat exchanger from a plurality of heat exchanger blocks which each have a multiplicity of heat exchange passages, each heat exchanger block having mounted on it a header which extends over at least part of one side of the heat exchanger block and which makes a flow connection between part of the heat exchange passages.

The heat exchanger block of a plate heat exchanger consists of a plurality of layers of heat exchange passages which in each case are delimited relative to one another by means of separating sheets. Closing strips and cover sheets form the outer frame of the heat exchanger block. Within a layer, further separating strips may be provided, which separate heat exchange passages for different material streams from one another. By a suitable arrangement of separating strips, plate heat exchangers can be used for the simultaneous heat exchange of a large number of fluid streams.

The heat exchanger block, which initially consists of loose components, is then soldered together in a soldering furnace, so that all the components are connected to one another in a leak-tight manner. Subsequently, headers, which are provided with a fluid connection, are welded on over the inlet and outlet orifices of the heat exchange passages. Semicylindrical shells are conventionally used as headers. The fluid connection is formed by tubular connection pieces which are arranged, opposite the inlet and outlet orifices of the heat exchange passages, in the semicylindrical casing of the header. The pipelines for the fluid streams to be supplied and to be discharged are connected to these tubular connection pieces.

For manufacturing reasons, for example because of the size of the soldering furnace, limits are placed on the dimensions of a heat exchanger block. When relatively large quantities of fluid are to be heated or cooled, it is necessary for two or more heat exchanger blocks to be arranged in parallel. Hitherto, in such a parallel arrangement, each heat exchanger block has been provided with corresponding headers and with the tubular connection pieces welded to the latter. For each material stream, a collecting line is provided, to which the corresponding tubular connection pieces are connected. The pipework connecting the heat exchanger blocks to one another and to the corresponding connecting lines consequently becomes extremely complex and entails a high outlay.

The object of the present invention is, therefore, to develop a method for producing a plate heat exchanger from a plurality of heat exchanger blocks, in which method the outlay in terms of pipework is as low as possible.

This object is achieved by means of a method of the type mentioned in the introduction, the heat exchanger blocks being arranged next to one another, and the headers of two adjacent heat exchanger blocks being provided on their mutually confronting sides with orifices and being connected to one another in such a way that a flow connection occurs between the two headers.

According to the invention, the plate heat exchanger is produced from a plurality of heat exchanger blocks. Each heat exchanger block has a multiplicity of heat exchange passages. The heat exchange passages can be divided into specific groups, the heat exchange passages of a group serving in each case for routing a specific fluid stream. Headers are in each case mounted over the inlet and outlet orifices into the heat exchange passages of a group in such a way that a flow connection is made between these passages.

The header, sometimes also designated as a collector, covers part of one side of a heat exchanger block and with this side forms a closed-off space, into which the inlet or outlet orifices of a group of heat exchange passages issue.

The heat exchanger blocks are arranged next to one another in such a way that at least one header of one heat exchanger block is adjacent to one header of another heat exchanger block or lies opposite the said header. Depending on the arrangement of the heat exchanger blocks, the headers are directly contiguous to one another or are spaced apart somewhat from one another.

The two headers are then provided on their mutually confronting sides with orifices and connected to one another, so that a flow connection is formed between the two headers. This results in a common header for both heat exchanger blocks, and via this, for example, a fluid supplied to this common header is distributed to the corresponding heat exchange passages of the two heat exchanger blocks.

According to the invention, the individual heat exchanger blocks are connected to one another on the flow side by means of the direct connection of their respective headers to form a common header. It is no longer necessary to provide each individual header with a separate fluid connection or tubular connection piece and to connect the individual fluid connections to one another by means of pipework.

Preferably, the heat exchanger blocks are arranged next to one another in such a way that the mutually adjacent sides of two headers are arranged essentially perpendicularly to that side of the respective heat exchanger block over which the header extends. The orifices of the headers which serve for the flow connection of the latter are arranged in a plane which lies essentially perpendicularly to the plane in which the corresponding inlet and outlet orifices into the heat exchange passages are located. That is to say, the flow connection of the two headers is not exactly located directly opposite the respective inlet and outlet orifices of the heat exchange passages.

The fluid connection, that is to say the opening of the header to the pipelines supplying and discharging the respective fluid stream, is preferably likewise arranged in a plane which lies essentially perpendicularly to the plane in which the corresponding inlet and outlet orifices into the heat exchange passages are located. That is to say, the fluid connection is not exactly located directly opposite the inlet and outlet orifices.

According to the invention, all the fluid connections may be provided on two opposite sides of the individual heat exchanger blocks. Particularly preferably, the heat exchanger blocks are configured in such a way that all the fluid connections are located on the same side of the respective heat exchanger block. The pipelines for supplying and discharging the material streams brought into heat exchange with one another therefore no longer have to be led around the heat exchanger block in a complicated way. The outlay in terms of pipework is appreciably reduced.

Preferably, the headers possess a semicircular cross section, in particular semicylindrical shells have proved appropriate as headers. In such a header design in the form of a half-shell, the two semicircular base surfaces are preferably provided with orifices and connected to one another. For reasons of strength, it may be advantageous for the header base surface located opposite the flow connection of the two headers not to be oriented perpendicularly, but, for example, obliquely to the semicylindrical casing.

Advantageously, the common header resulting from the connection according to the invention of two adjacent headers is provided with a fluid connection located in a side of the common header which lies essentially perpendicularly to those sides of the two heat exchanger blocks over which the two headers extend. For example, in the case of semicylindrical headers, the fluid connection is not provided in the semicylindrical casing of the common header, but in one of the semicircular base surfaces which are oriented perpendicularly to the cylinder axis.

It is known for the supply and discharge of the fluid streams to form a semicylindrical header of a heat exchanger block to be carried out via a tubular connection piece which is welded onto the half-shell. The half-shell has to be provided at this point with a corresponding orifice, although this markedly weakens the strength of the half-shell. By contrast, if the fluid connection is provided in one of the semicircular base surfaces, the common header has higher strength for identical wall thicknesses. Conversely, in the case of a predetermined desired strength, a lower wall thickness can be selected in the design of the header, with the result that the costs are lowered.

Preferably, the orifice introduced into the header extends over the entire cross section of the header and particularly preferably, with the cross section being maintained, is connected to the adjacent header. This results in a continuous header which extends over two or more heat exchanger blocks.

Advantageously, the heat exchanger blocks are arranged, spaced apart, next to one another, so that a gap remains between the heat exchanger blocks. The heat exchanger blocks are connected to one another, as a rule welded to one another, preferably with a spacer being installed. The spacer used may be, for example, a correspondingly shaped sheet or a strip.

It is particularly beneficial if the spacer is arranged in the region of the common header in such a way that that side of the header which faces the heat exchanger blocks is completely covered by the spacer in the region of the gap. In this case, the space inside the common header is delimited by the header itself, for example a semitubular shell, by the side walls of the heat exchanger blocks and by part of the spacer.

The common header not only serves for distributing the supplied fluid stream to the heat exchange passages or for collecting the fluid emerging from the heat exchange passages, but also for supplying and discharging the corresponding fluid streams to and from individual heat exchanger blocks.

In a preferred embodiment, this double function is further taken into account in that means for routing the flow of the fluid supplied or discharged via the fluid connection are provided within the header. For example, the header may have arranged within it a guide sheet which subdivides the space within the header into a flow region, which preferably serves for the supply and discharge of the fluid, and into a distribution region, in which the flow is calmed and as uniform a distribution as possible of the fluid to the heat exchange passages takes place.

Figure 2:
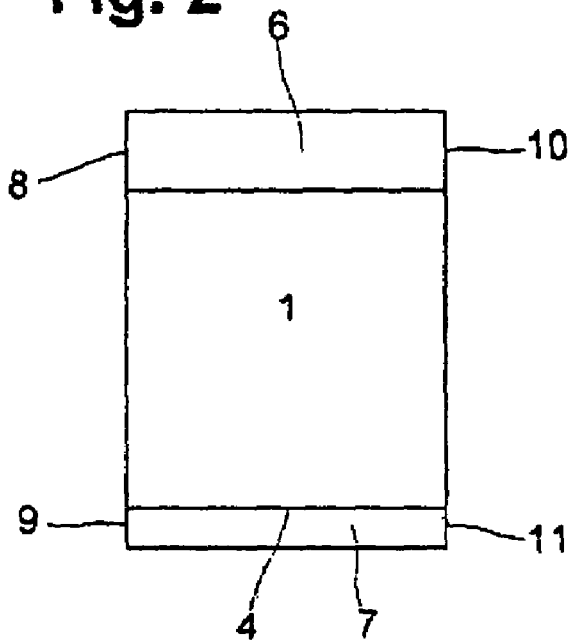
Figure 3:
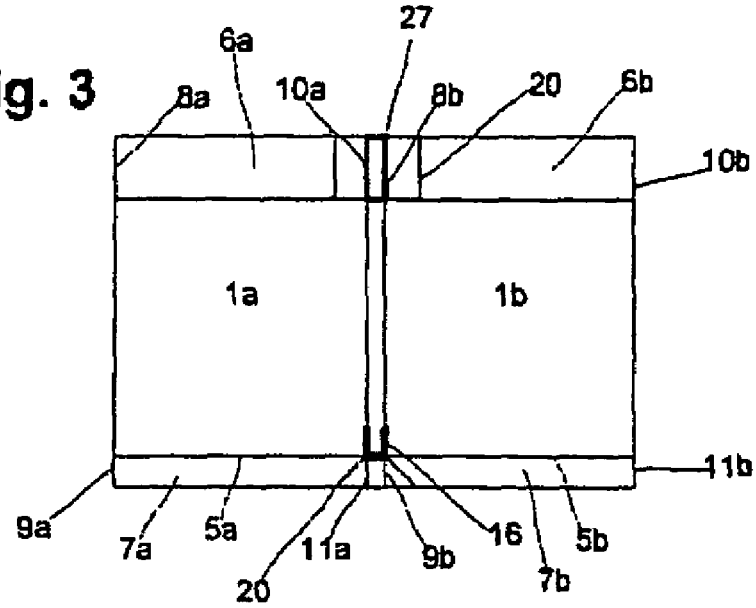
Figure 4:
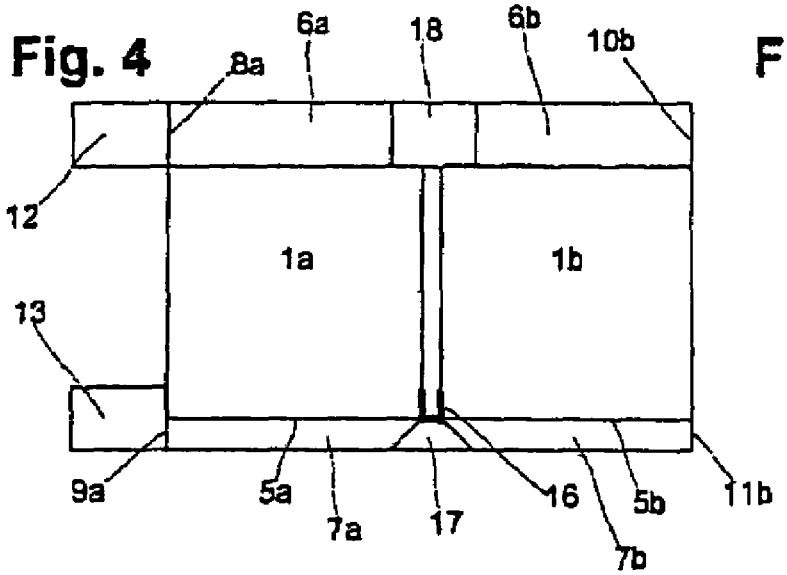
Figure 5:
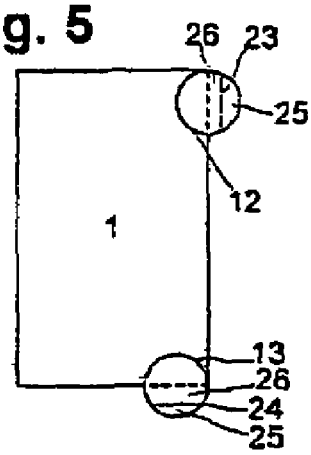

The invention and further particulars of the invention are explained in more detail below with reference to exemplary embodiments illustrated in the drawings in which:

FIGS. 1 and 2 show in each case a side view of a heat exchanger block with two headers, FIG. 3 shows two heat exchanger blocks arranged next to one another for the production of a plate heat exchanger according to the invention, FIG. 4 shows a plate heat exchanger according to the invention, and FIG. 5 shows a side view of the plate heat exchanger according to FIG. 4.

FIGS. 1 and 2 illustrate diagrammatically a heat exchanger block 1 with headers 6, 7. The heat exchanger block 1 has a multiplicity of heat exchange passages which are not shown in the figures for the sake of clarity. The inlet and outlet orifices of a group of heat exchange passages are located in the region 2 on a side wall 3 of the heat exchanger block 1 and in the region 4 on the underside 5 of the heat exchanger block 1 respectively. Headers 6, 7 are welded onto the regions 2, 4 having the inlet and outlet orifices.

The headers 6, 7 are designed as semicylindrical shells with base surfaces 8, 9, 10, 11. Arranged in the headers 6, 7 are guide sheets 23, 24 which subdivide the space within the headers 6, 7 into a flow region 25 and a distribution region 26. The guide sheets 23, 24 are provided with a multiplicity of orifices, so that gas and liquid exchange between the flow region 25 and the distribution region 26 is possible.

FIG. 3 shows an intermediate stage in the production of a plate heat exchanger according to the invention. The heat exchanger blocks 1*a*, 1*b* are constructed identically to the heat exchanger block 1 illustrated in FIGS. 1 and 2.

The heat exchanger blocks 1*a*, 1*b* are first subjected, together with their respective headers 6*a*, 6*b*, 7*a*, 7*b*, to a leak-tightness test and to a compressive-strength test. After the successful testing, all the base surfaces 8*a*, 9*a*, 10*a*, 11*a* of the headers 6*a* and 7*a* of the heat exchanger block 1*a* and the base surfaces 8*b*, 9*b* of the headers 6*b*, 7*b* of the heat exchanger block 1*b* are separated. As illustrated in FIG. 3 by broken lines 20, separation takes place on the two mutually confronting sides of the headers 6*a*, 6*b*, 7*a*, 7*b* obliquely to the axis of the semicylindrical headers 6*a*, 7*a*, 6*b*, 7*b*. The base surfaces 8*a*, 9*a* of the heat exchanger block 1*a* are cut off perpendicularly to the axis of the semicylindrical headers 6*a*, 7*a*.

The two heat exchanger blocks 1*a*, 1*b* are then welded together at their lower end by means of a sheet 16. The U-shaped sheet 16 is fastened to the heat exchanger blocks 1*a*, 1*b* in such a way that the base of the U-shaped sheet 16 connects the undersides 5*a*, 5*b* of the two blocks 1*a*, 1*b* in such a way as to produce a continuous plane. In the region of the headers 6*a*, 6*b*, the two heat exchanger blocks 1*a*, 1*b* are likewise connected to a U-shaped sheet 27, the base of which is located in the drawing plane and extends from the upper edge of the heat exchanger blocks 1*a*, 1*b* as far as the lower edge of the headers 6*a*, 6*b*, at which edge the semicylindrical header casing meets the heat exchanger block 1*a*, 1*b*.

FIGS. 4 and 5 show the finished plate heat exchanger. An adapted intermediate piece 17, 18 in the form of a piece of cake is inserted in each case between the headers 6*a*, 6*b* and the headers 7*a*, 7*b* of the two heat exchanger blocks 1*a*, 1*b* and is welded to the headers 6*a*, 6*b*, 7*a*, 7*b* and to the U-shaped sheets 16. Pipelines 12, 13 are welded to the base surfaces 8*a*, 9*a* of the headers 6*a*, 7*a*. The two pipelines 12, 13 are located on the same side of the heat exchanger block 1*a*. The connection and further pipework of the heat exchanger are thus easily possible.

During operation, for example, a fluid is supplied by the pipeline 12 and flows into the flow region 25, separated by the guide sheet 23, of the header 6*a* and, via the connection piece 18 in the form of a piece of cake, into the flow region 25 of the header 6*b*. The guide sheets 23 of the two headers 6*a*, 6*b* have a multiplicity of orifices, through which the fluid passes into the flow-calmed distribution regions 26. In the distribution regions 26 of the headers 6*a*, 6*b*, the fluid is distributed to the corresponding heat exchange passages of the heat exchanger blocks 1*a*, 1*b*.

Similarly, after heat exchange, the fluid is discharged again via the headers 7*a*, 7*b* having the intermediate connection piece 17 and via the pipeline 13. The headers 7*a*, 7*b* are likewise subdivided by a guide sheet 24 into a flow-calmed region 26 and a flow region 25. The flow-calmed region 26 in this case serves essentially for collecting and combining the fluid emerging from the heat exchange passages, and the flow region 25 serves for discharging the fluid to the pipeline 13.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10308015.5, filed Feb. 25, 2003, European application No. 03012311.1, filed May 28, 2003, and German application No. 10316712.9 filed Apr. 11, 2003 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method for producing a plate heat exchanger from a plurality of heat exchanger blocks comprising a first heat exchanger block and a second heat exchanger block each block having a multiplicity of heat exchange passages having inlet and outlet orifices, and each of said heat exchanger blocks having mounted on a first side thereof a first header which extends over at least part of said first side of the heat exchanger block and which makes a flow connection between part of said heat exchange passages, said method comprising (a) arranging said first and second heat exchanger blocks proximate to one another so that said first header of said first heat exchanger block is proximate to said first header of said second heat exchanger block and said first and second heat exchangers are spaced apart from one another, (b) connecting said first and second heat exchanger blocks to one another by means of a U-shaped sheet having a base and two sides whereby the base of the U-shaped sheet connects together the first sides of the two heat exchanger blocks, to which said headers are mounted, in such a way as to produce a continuous plane, (c) providing said first header of said first heat exchanger block and said first header of said second heat exchanger block, on their mutually confronting sides, with orifices, and (d) connecting said orifices of said mutually confronting sides via a connection piece introduced between the two headers whereby a flow connection is provided between the two headers, wherein the step of connecting said first and second heat exchanger blocks to one another by means of the U-shaped sheet can be performed before or after the step of connecting the orifices of the mutually confronting sides of the first headers via said connection piece.

2. A method according to claim 1, wherein said confronting sides of the headers (6*a*, 6*b*; 7*a*, 7*b*) are each arranged essentially perpendicularly to said first side (5*a*, 5*b*) of the heat exchanger block (1*a*, 1*b*) over which the respective header (6*a*, 6*b*; 7*a*, 7*b*) extends.

3. A method according to claim 1, wherein said first header of said first heat exchange block characterized in that one of the two headers (6*a*, 6*b*; 7*a*, 7*b*) is provided with a first inlet fluid connection (12, 13), and said inlet the fluid connection (12, 13) is connected to a second side of said first heat exchange block which is perpendicular to the first side of said first heat exchange block.

4. A method according to claim 3, wherein said first heat exchanger block is provided with a second header and said second header is provided with a second inlet fluid connection and said first and second fluid connections (12, 13) are provided on the same side of said first heat exchanger block.

5. A method according to claim 1, wherein the two headers (6*a*, 6*b*; 7*a*, 7*b*) are connected to one another in such a way that their cross section does not decrease at the connection point (17, 18).

6. A method according to claim 1, wherein the headers (6*a*, 6*b*; 7*a*, 7*b*) are of semicylindrical design.

7. A method according to claim 1, wherein a connection piece (17, 18) is introduced between the two headers (6*a*, 6*b*; 7*a*, 7*b*).

8. A method according to claim 1, wherein the heat exchanger blocks (1*a*, 1*b*) are tested for leak-tightness and/or compressive strength before their headers (6*a*, 6*b*; 7*a*, 7*b*) are connected to one another.

9. A method according to claim 1, further comprising subdividing each of said first headers by a guide sheet to form a flow-calmed region and a flow region within each of said first headers.

10. A method according to claim 1, wherein each of said heat first and second exchanger blocks have mounted on a second side thereof a second header which extends over at least part of said second side of the heat exchanger block and which makes a flow connection between part of said heat exchange passages, and said method further comprises arranging said first and second heat exchanger blocks (1*a*, 1*b*) proximate to one another so that said second header of said first heat exchanger block is proximate to said second header of said second heat exchanger block and said first and second heat exchanger are spaced apart from one another, connecting said first and second heat exchanger blocks to one another by means of a second U-shaped sheet having a base and two sides whereby the base of said second U-shaped sheet connects together the second sides of the two heat exchanger blocks, to which said second headers are mounted, in such a way as to produce a continuous plane, providing said second header of said first heat exchanger block and said second header of said second heat exchanger block, on their mutually confronting sides, with orifices, and connecting said orifices of said mutually confronting sides of said second headers via a second connection piece introduced between the two second headers whereby a flow connection is provided between the two second headers, wherein the step of connecting said first and second heat exchanger blocks to one another by means of the second U-shaped sheet can be performed before or after the step of connecting the orifices of the mutually confronting sides of the second headers via said second connection piece.

11. A method according to claim 1, wherein the side of the connection piece which faces the heat exchanger blocks is completely covered by the first side of each heat exchanger block on which their respective headers are mounted and the base of U-shaped sheet.

12. A method according to claim 10, wherein the side of the connection piece which faces the heat exchanger blocks is completely covered by the first side of each heat exchanger block on which their respective headers are mounted and the base of U-shaped sheet.

13. A method according to claim 12, wherein the side of the second connection piece which faces the heat exchanger blocks is completely covered by the second side of each heat exchanger block on which their respective headers are mounted and the base of said second U-shaped sheet.

14. A method according to claim 1, wherein said first header of said first heat exchange block is provided with a first inlet fluid connection, and said inlet fluid connection is connected to a third side of said first heat exchange block which is perpendicular to the first side of said first heat exchange block.

15. A method according to claim 14, wherein said second header of said first heat exchanger block is provided with a second fluid connection and said first and second fluid connections are provided on the same side of said first heat exchanger block.

16. A method according to claim 1, wherein the step of connecting said first and second heat exchanger blocks to one another by means of the U-shaped sheet is performed before the step of connecting the orifices of the mutually confronting sides of the first headers via said connection piece.

17. A method according to claim 1, wherein the step of connecting said first and second heat exchanger blocks to one another by means of the U-shaped sheet is performed after the step of connecting the orifices of the mutually confronting sides of the first headers via said connection piece.

18. A method according to claim 10, wherein the step of connecting said first and second heat exchanger blocks to one another by means of the second U-shaped sheet can be performed before the step of connecting the orifices of the mutually confronting sides of the second headers via said second connection piece.

19. A method according to claim 10, wherein the step of connecting said first and second heat exchanger blocks to one another by means of the second U-shaped sheet can be performed after the step of connecting the orifices of the mutually confronting sides of the second headers via said second connection piece.

20. A method for producing a plate heat exchanger from a plurality of heat exchanger blocks comprising a first heat exchanger block and a second heat exchanger block, each block having a multiplicity of heat exchange passages having inlet and outlet orifices, and each of said heat exchanger blocks having mounted on a first side thereof a first semicylindrical header with two bases which extends over at least part of said first side of the heat exchanger block and which makes a flow connection between part of said heat exchange passages, said method comprising:

arranging said first and second heat exchanger blocks proximate to one another so that said first header of said first heat exchanger block is proximate to said first header of said second heat exchanger block and said first and second heat exchangers are spaced apart from one another, whereby one base of said first header of said first heat exchanger block confronts one base of said first header of said second heat exchanger block, subjecting said first and second heat exchanger blocks to a leak-tightness test and to a compressive-strength test, removing all bases surfaces of the two first headers, whereby the two confronting bases are removed obliquely to the axis of the semicylindrical first headers, and the two remaining bases are removed perpendicularly to the axis of the semicylindrical first headers, connecting said first and second heat exchanger blocks to one another by means of a U-shaped sheet having a base and two sides whereby the base of the U-shaped sheet connects together the first sides of the two heat exchanger blocks, to which said headers are mounted, in such a way as to produce a continuous plane, and connecting the mutually confronting sides of said two first headers via a connection piece introduced between the two headers whereby the side of the connection piece which faces the heat exchanger blocks is completely covered by the first side of each heat exchanger block on which their respective headers are mounted and the base of U-shaped sheet such that said connection piece provides a flow connection occurs between the two headers.

21. A method according to claim 20, further comprising welding a pipe to the side of the first header of the first heat exchanger block from which the base was removed perpendicularly.

22. A method for producing a plate heat exchanger from a plurality of heat exchanger blocks comprising a first heat exchanger block and a second heat exchanger block, each block having a multiplicity of heat exchange passages having inlet and outlet orifices, and each of said heat exchanger blocks having mounted on a first side thereof a first header which extends over at least part of said first side of the heat exchanger block and which makes a flow connection between part of said heat exchange passages, said method comprising arranging said first and second heat exchanger blocks proximate to one another so that said first header of said first heat exchanger block is proximate to said first header of said second heat exchanger block and said first and second heat exchangers are spaced apart from one another, providing said first header of said first heat exchanger block and said first header of said second heat exchanger block, on their mutually confronting sides, with orifices, and connecting said first and second heat exchanger blocks to one another by means of a sheet, connecting said orifices of said mutually confronting sides via a connection piece introduced between the two headers whereby said connection piece, said sheet connecting said first and second heat exchanger blocks, and said two first headers form a continuous header which extends over said first and second heat exchanger blocks.

* * * * *

UNITED STATES PATENT AND TRADEMARK OFFICE

CERTIFICATE OF CORRECTION

PATENT NO. : 7,100,280 B2
APPLICATION NO. : 10/785484
DATED : September 5, 2006
INVENTOR(S) : Stefan Moller It is certified that error appears in the above-identified patent and that said Letters Patent is hereby corrected as shown below:

Column 5, line 40, reads “exchanger block each” should read -- exchanger block, each --;
Column 7, line 14, reads “of U-shaped” should read -- of the U-shaped --;
Column 7, line 19, reads “of U-shaped” should read --of the U-shaped --;
Column 8, line 13, reads “bases surfaces” should read -- base surfaces --; and
Column 8, line 31, reads “connection occurs between” should read -- connection between --

Signed and Sealed this

Fourteenth Day of August, 2007

JON W. DUDAS
*Director of the United States Patent and Trademark Office*